US006404143B1

(12) United States Patent
Pilz et al.

(10) Patent No.: US 6,404,143 B1
(45) Date of Patent: Jun. 11, 2002

(54) METHOD FOR STARTING UP THE ELECTRICAL EQUIPMENT OF A LIGHTING SYSTEM

(75) Inventors: Axel Pilz, Neuenstein; Andreas Huber, Traunreut, both of (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/517,094

(22) Filed: Mar. 1, 2000

(30) Foreign Application Priority Data

Mar. 5, 1999 (DE) ..... 199 09 646

(51) Int. Cl.[7] ..... H05B 37/00

(52) U.S. Cl. ..... 315/294; 315/295; 315/155; 315/312

(58) Field of Search ..... 315/291, 292, 315/293, 294, 295, 224, 312, 316, 324, 362, 318, 320, 149–159

(56) References Cited

U.S. PATENT DOCUMENTS 5,010,459 A * 4/1991 Taylor et al. ..... 315/292
5,350,977 A * 9/1994 Hamamoto et al. ..... 315/324
5,406,176 A * 4/1995 Sugden ..... 315/292
6,025,679 A * 2/2000 Harper et al. ..... 315/312
6,138,241 A * 10/2000 Eckel et al. ..... 315/320

FOREIGN PATENT DOCUMENTS

EP 0639938 2/1995

* cited by examiner

*Primary Examiner*—Don Wong
*Assistant Examiner*—Wilson Lee
(74) *Attorney, Agent, or Firm*—Carlo S. Bessone

(57) ABSTRACT

The invention relates to a starting-up method for a lighting system, which has a plurality of luminaries (L1; L2; L3; L4; L5; L6) which are fitted with lamps (LP1; LP2; LP3; LP4; LP5; LP6; LP7; LP8) and electric equipment for operating these lamps, a control device (St) for actuating the electrical equipment (B1; B2; B3; B4; B5; B6) and control elements (S) for controlling and programming the control device (St). During the starting-up phase of the lighting system, system initialization is carried out, during which each electrical equipment item (B1; B2; B3; B4; B5; B6) is assigned an individual appliance address, which ensures that the equipment (B1; B2; B3; B4; B5; B6) and the luminary (L1; L2; L3; L4; L5; L6) are identified by the control device (St). According to the invention, the individual address which is assigned to the equipment (B1; B2; B3; B4; B5; B6) by the control device (St) is transmitted by a brief interruption in the electrical contact to one of the lamps (LP1; LP2; LP3; LP4; LP5; LP6; LP7; LP8) in this electrical equipment (B1; B2; B3; B4; B5; B6).

2 Claims, 1 Drawing Sheet

METHOD FOR STARTING UP THE ELECTRICAL EQUIPMENT OF A LIGHTING SYSTEM

Figure 1:
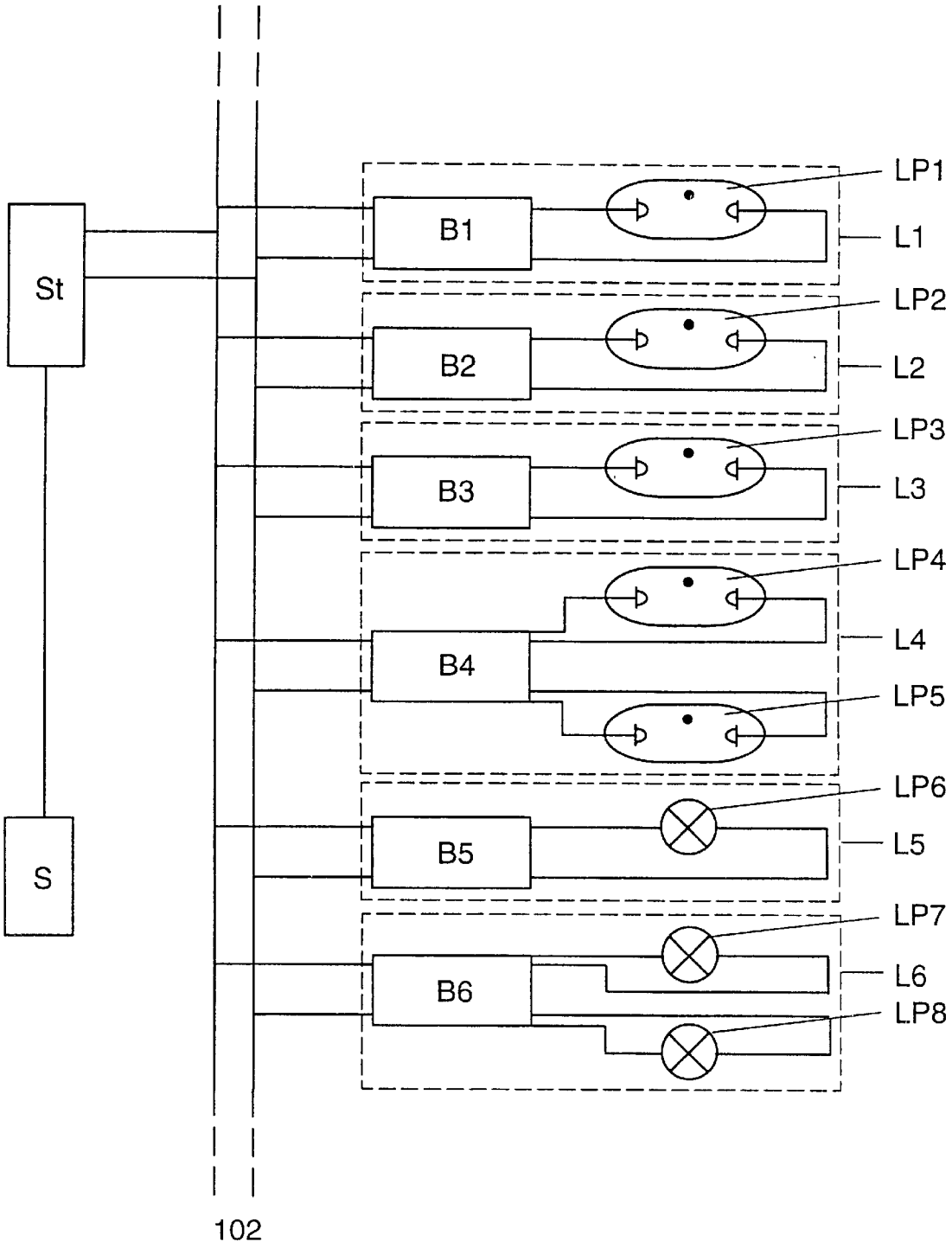

The invention relates to a method for starting up the electrical equipment of a lighting system.

I. TECHNICAL FIELD

The method according to the invention is intended for a lighting system which has a large number of electrical luminaries, at least one control device for actuating these luminaries, and control elements for controlling and programming the lighting system. Normally, all the electrical equipment is connected to a control line, which is in turn connected to the control interfaces of all the control devices in the lighting system. The equipment comprises, for example, electronic transformers for operating low-voltage incandescent halogen lamps, phase-gating dimmers, or electronic ballasts for low-pressure discharge lamps. Individual luminaries, or luminaries combined into groups, can be switched or regulated via the control devices, by operating a switch or a regulator, with the aid of control elements which are, for example, in the form of switches or regulators. However, the control elements are also used for programming the equipment via the control devices. In particular, control elements can be used to combine individual luminaries to form a group which can be switched or regulated simultaneously. However, first of all, it is necessary to ensure that the control devices can identify the luminaries assigned to them. For this purpose, the system is initialized before or during the process of starting up the lighting system for the first time, that is to say a method is carried out to allow the corresponding control devices to identify the individual electrical equipment items. This method is a precondition for the control devices being able to identify and actuate the equipment assigned to them. Normally, the identification of the equipment by the control devices is ensured by means of a coding device on each luminary.

II. PRIOR ART

European Laid Open Specification EP 0 639 938 A1 describes a method for actuating a lighting system as claimed in the preamble of patent claim 1. In particular, this document discloses a method for assignment of group addresses to the luminaries and electrical loads in the lighting system. Laid Open Specification EP 0 639 938 A1 does not describe the way in which the individual luminaries are identified by the control devices.

III. DESCRIPTION OF THE INVENTION

The object of the invention is to specify a method for starting up a lighting system which, during a starting-up phase of the lighting system, allows each individual electrical equipment item to be assigned to a control device to be identified by this control device, using simple means.

The method according to the invention for starting up a lighting system which has a plurality of electric luminaries which are fitted with lamps and equipment for operating these lamps, and at least one control device for actuating the electrical equipment and control elements for controlling and programming the at least one control device, has, during a starting-up phase of the lighting system, method steps for the at least one control device to assign addresses to the electrical equipment. According to the invention, the following method steps are carried out in order to assign addresses to the electrical equipment:

a) Applying supply voltage to the electrical equipment which is to be actuated by the at least one control device, b) Transmitting a control command, which initiates the address assignment, from the at least one control device to the electrical equipment which is to be actuated by this control device, c) Selecting an electrical equipment item, which is to be actuated by the at least one controt device, by interrupting and remaking the electrical contact to a lamp of this electrical equipment, d) Signaling the contact interruption back from the selected electrical equipment to the at least one control device, e) Transmitting of an address from an address supply, which has not yet been used, of the at least one control device to the selected electrical equipment, f) Storing the address assigned to the selected electrical equipment in a non-volatile memory in the equipment, and cancellation of the selection, g) Repeating steps c) to f) for the other luminaries, whose electrical equipment is actuated by the at least one control device and to which addresses must be assigned.

The method according to the invention allows the corresponding control device to assign individual addresses to each luminary and to each equipment item, using simple means. By briefly interrupting the electrical contact between the equipment to be addressed and a lamp to be operated by this equipment, this equipment and this luminary are selected such that they can be identified by the corresponding control device, since the equipment associated with this luminary transmits a signs to the control device when the lamp is not connected. The lamps which are assigned to the equipment to be addressed need not necessarily be in use while this is being done. The electrical contact between the equipment and the lamp is advantageously produced by briefly disconnecting the electrical connection between the lamp socket and the lamp base. In the case of fluorescent lamps in the form of strips, it is sufficient, for example, to rotate the lamp to a quarter of a turn about its axis, in order to interrupt the electrical contact between the lamp socket and the lamp. During the starting-up phase, the control device reacts to the brief interruption in the electrical contact by transmitting an address to this luminary, or to the equipment which is associated with this luminary and operates the lamp, and subsequently canceling the selection of this equipment. The equipment stores the address assigned to it in a non-volatile memory. The nature of address assignment according to the invention does not require any coding switches on the equipment. In particular, the equipment, which is normally arranged concealed in the luminary, does not need to be made accessible for the initialization method. Furthermore, no specialist personnel are required to carry out the initialization method according to the invention.

IV. BRIEF DESCRIPTION OF THE DRAWING

FIG. 1 shows a schematic block diagram of a lighting system of the invention.

V. DESCRIPTION OF THE PREFERRED EXEMPLARY EMBODIMENT

The invention will be explained in more detail in the following text with references to a preferred exemplary embodiment. FIG. 1 shows a schematic block diagram of a lighting system, on the basis of which the method according to the invention will be explained in more detail, by way of example. The lighting system has a large number of electric luminaries L1; L2; L3; L4; L5; L6 of which only six are illustrated schematically in the figure. Each of these luminaries L1 to L6 comprises an equipment B1; B2; B3; B4; B5; B6 and at least one lamp LP1; LP2; LP3; LP4; LP5; LP6; LP7; LP8 connected to it. The lamps are each inserted in a lamp socket (not shown) in the corresponding luminary. A fluorescent lamp LP1 to LP3, for example, is respectively connected to the equipment items E1 to B3, while, for example two series-connected fluorescent lamps, LP4, LP5 are operated on the equipment B4. The equipment B5 is used, for example, to operate a low-voltage incandescent halogen lamp LP6, while two low-voltage incandescent halogen lamps LP7, LPB, for example, are connected to the equipment B6. The electric luminaries L1 to L6 are actuated by a control device St, which is connected via a two-core control line 102 to the equipment E1 to B6 of the respective luminary L1 to L6 to be actuated by this control device St. The communication interface of each of these equipment items E1 to B6 is connected to the cores of the two-core control line 102. Furthermore, the lighting system has control elements S for controlling and programming the control device St, and these control elements S are, for example, in the form of switches, push buttons, or regulators. When the lighting system is being started up for the first time, system initialization must be carried out in order that the control device St can identify the equipment B1 to B6 assigned to it. For this purpose, all the equipment items B1 to B6 which are intended to be assigned to the control device St are first of all switched on. The control device St is not required for this switching-on process. The program-controlled initialization method is then initiated by operating one or more control elements S. The control device St then switches to the initialization mode and transmits the start command for the initialization method, via the control line 102, to all the equipment items B1 to B6 connected to it. The control device St then checks, at periodically recurring time intervals, whether a luminary L1 to L6 and, respectively, an equipment item B1 to B6 of a luminary L1 to L6 has been selected. For example, in order to select the equipment B4, the electrical connection for one of the lamps LP4 or LP5 connected to this equipment B4 is interrupted. For this purpose, it is sufficient to briefly interrupt the electrical contact between the lamp LP4 or LP5 and the lamp socket associated with it. During the initialization phase, the equipment B4 reacts to the interruption to the electrical contact to the lamp LP4 or LP5 by signaling back to the control device St., The equipment B4 is selected by this return signal. The control device St then transmits an address, which has not yet been used, from its address supply to the selected equipment B4. The selected equipment B4 stores this address which is assigned to it, as its appliance address, in a non-volatile memory in the equipment B4, and the selection of the equipment B4 and of the luminary L4 is canceled. The same procedure is carried out for the other equipment items and luminaries which need to be assigned to the control device St. Once all the equipment items have been assigned an appliance address in this way, the initialization phase is ended by entering the appropriate command via the control elements S. Each of the luminaries L1 to L6 and each of the respective equipment items B5 to B6 has an individual appliance address at the end of the initialization phase, which address allows the control device St to identify each of these luminaries L1 to L6.

The equipment items and luminaries can be distinguished by virtue of the assignment of appliance addresses. This allows individual equipment items and luminaries to be combined to form groups subsequently. However, this is not required for operation of the lighting systems.

The starting-up method according to the invention can be carried out once again at any desired subsequent time after the initial starting-up of the lighting system if, for example, further electrical equipment and/or luminaries are added to the lighting system.

What is claimed is:

1. A method for starting up an electrical equipment of a light system having a plurality of electric luminaries (L1; L2; L3; L4; L5; L6) fitted with lamps (LP1; LP2; LP3; LP4; LP5; LP9; LP7; LP8) and the electrical equipment (B1; B2; B3; B4; B5; B6) for operating these lamps, at least one control device (St) for actuating the electrical equipment (B1; B2; B3; B4; B5; B6) and control elements (S) for controlling and programming the at least one control device (St), such that during a start-up phase of the lighting system, the electrical equipment (B1; B2; B3; B4; B5; B6) is assigned addresses by the at least one control device (St), wherein the following method steps are carried out in order to assign addresses to the electrical equipment (B1; B2; B3; B4; B5; B6):

a) applying a supply voltage to the electrical equipment (B1; B2; B3; B4; B5; B6) which is to be actuated by the at least one control device (St), b) transmitting a control command, which initiates an address assignment, from the at least one control device (St) to the electrical equipment (B1; B2; B3; B4; B5; B6) which is to be actuated by this control device (St), c) selecting the electrical equipment (B1; B2; B3; B4; B5; B6) which is to be actuated by the at least one control device (St), by interrupting and remaking electrical contact to a lamp (LP1; LP2; LP3; LP4; LP5; LP9; LP7; LP8) of the electrical equipment (B1; B2; B3; B4; B5; B6), d) signaling contact interruption back from the selected electrical equipment (B1; B2; B3; B4; B5; B6) to the at least one control device (St), e) transmitting an unused address from an address supply, which has not yet been used, of the at least one control device (St) to the selected electrical equipment (B1; B2; B3; B4; B5; B6), f) storing the address assigned to the selected electrical equipment (B1; B2; B3; B4; B5; B1) in a non-volatile memory in the equipment, and cancellation of the selection, g) repeating steps c) to f) for the other luminaries (L1; L2; L3; L4; L5; L6), whose equipment (B1; B2; B3; B4; B5; B6) is actuated by the at least one control device (St) and to which addresses must be assigned.

2. The method as claimed in claim 1, wherein electrical contact between the lamp (LP1; LP2; LP3; LP4; LP5; LP9; LP7; LP8) and the selected electrical equipment (B1; B2; B3; B4; B5; B6) is interrupted by interrupting electrical contact between the lamp (LP1; LP2; LP3; LP4; LP5; LP9; LP7; LP8) and its lamp socket.

* * * * *